United States Patent [19]

Gabis et al.

[11] Patent Number: 4,907,642

[45] Date of Patent: Mar. 13, 1990

[54] CHILL MOULDING PROCESS, PARTICULARLY FOR METALS, AND APPARATUS AND MOLD FOR USE THEREIN

[75] Inventors: Victor Gabis, Orleans; Christian Gailly, Meung-Sur-Loire, both of France

[73] Assignee: Centre National De La Recherche Scientifique (CNRS), Paris, France

[21] Appl. No.: 201,277

[22] Filed: May 23, 1988

[30] Foreign Application Priority Data

May 27, 1987 [FR] France ..... 87 07470

[51] Int. Cl.[4] ..... B22D 18/08

[52] U.S. Cl. ..... 164/457; 164/119; 164/63; 164/155; 164/306; 164/256; 164/66.1; 164/70.1

[58] Field of Search ..... 164/119, 306, 307, 308, 164/309, 262, 264, 70.1, 63, 65, 66.1, 256, 257, 258, 259, 155, 457

[56] References Cited

U.S. PATENT DOCUMENTS

| | | | |
|---|---|---|---|
| 2,119,242 | 5/1938 | Flammang et al. | 164/119 |
| 2,995,788 | 8/1961 | Sunday | 164/70.1 |
| 3,529,657 | 9/1970 | Bucy . | |
| 3,823,760 | 7/1974 | Bloomfield et al. | 164/306 |
| 3,862,656 | 1/1975 | Weiler | 164/119 |
| 3,900,064 | 8/1975 | Chandley et al. . | |
| 4,425,958 | 1/1984 | Luthy et al. | 164/119 |
| 4,550,763 | 11/1985 | Nikolov | 164/119 |

FOREIGN PATENT DOCUMENTS

| | | | |
|---|---|---|---|
| 0055210 | 6/1982 | European Pat. Off. . | |
| 0061532 | 10/1982 | European Pat. Off. . | |
| 2452986 | 10/1980 | France . | |
| 55-136555 | 10/1980 | Japan | 164/259 |
| 57-106463 | 7/1982 | Japan | 164/306 |
| 615484 | 1/1949 | United Kingdom | 164/63 |

OTHER PUBLICATIONS

"Fabrication de Pieces Moulees Par Aspiration Sous Vide (Coulee Par Depression)", Giessereitechnik, Aug. 1960, E 2 422, by A. Ridny, pp. 248–249.

*Primary Examiner*—Richard K. Seidel
*Attorney, Agent, or Firm*—Young & Thompson

[57] ABSTRACT

A metallic mold (1) comprises two mold halves (3,4) which define between them a mold cavity connected to blowing means (56). The mold (1) is vertically movably mounted on a chassis (18) rigidly supporting an aspiration channel (16). To aspirate the metal, the mold is sealingly applied against the channel which is immersed in the bath (62). After filling of the mold cavity, the material solidifies in a constriction (26) of the channel. This permits raising the chassis (18) without the mold cavity emptying. Then, the mold (1) is raised relative to the channel (16) to break the material in the constriction and to let fall back into the bath the material (68) which was in the channel. Demolding is effected by separating the mold halves from each other.

25 Claims, 6 Drawing Sheets

CHILL MOULDING PROCESS, PARTICULARLY FOR METALS, AND APPARATUS AND MOLD FOR USE THEREIN

The present invention relates to a molding process, particularly for pieces of high melting point material such as ferrous metals and alloys, titanium, refractory oxides and the like, in which a lower inlet opening is immersed in a bath of molten material communicating with the cavity of a chill mold, the molten material fills this cavity by difference in pressure between the bath and the cavity, then before demolding the inlet opening is raised from the bath.

The present invention also relates to apparatus for practicing this process.

The present invention further relates to a chill mold for practicing the process or for use with the apparatus.

Such a process is disclosed in the publication GIESSEREITECHNIK, August 1960, pages 248,249, in an article entitled "Production of Molded Pieces by Aspiration of the Moldable Material under Vacuum".

This document describes the production of bronze sleeves by aspiration into a chilled mold, in the form of a bell, whose open base is immersed in a receptacle, then cessation of the aspiration to let the liquid melt flow back into the receptacle, keeping in the bell only the surface layer which has had the time to solidify.

Thus, the known process is limited to the production of hollow open pieces, without regard for precision as to dimensions and the condition of the interior surface, nor the thickness of the wall of the piece.

To produce pieces requiring positive molding of all their surfaces, it is disclosed in French Pat. No. 2,452,186 to use a sand mold downwardly elongated by a channel which is immersed in the liquid metal bath to aspirate the metal. When the cavities are filled, the melt standing in the channel solidifies quickly and locally before the channel has the time to be reheated. Advantage is taken of this local and rapid solidification to raise the mold from the bath, so as to complete said solidification. Demolding results in the destruction of the sand mold.

To mold ferrous metals in a chill mold, it is known to fill from above a hot mold. It is not possible to use a chill mold because in combination with the rapid solidification which produces a solid surface, the turbulence of filling from above results in mechanical defects in the obtained molded pieces.

This turbulence will be less if the filling is effected from below, as taught by French Pat. No. 2,452,186 in connection with a sand mold. Moreover, filling from below permits filling the mold directly from the bath, without transfer from one vessel to another, and thus with less apparatus, in less space and with less heat loss.

Moreover, filling from below involves achieving solidification in the channel before removing it from the bath. Following this solidification a solidified metal cap covers the lower end of the channel. With a sand mold, this is not troublesome because the demolding results in breaking up the mold. With a chill mold, which by definition is to be reused, this cap prevents demolding and this is why the teaching of French Pat. No. 2,452,186 has never been able to be used for chill molding.

GIESSEREITECHNICK does not provide a solution to the problem because this document does not disclose molding in the strict sense but simple formation of a solidified shell after the central fluid mass flows out. This is not useful if it is desired to fill a mold cavity and permit solidification of the metallic mass filling the cavity, because in that case the problem is precisely to prevent, by means of a solidified plug in the channel, the flow of liquid metal back to the bath, and this solidified plug in turn gives rise to the demolding problem set forth above.

According to U.S. Pat. No. 2,119,242, the mold can be filled from below with metal of low melting point. The channel remains permanently immersed in the bath. Solidification progresses from the extremities of the mold cavity toward a constriction of the channel, which is the hottest point. When the solidification front reaches the constriction, the mold is separated from the channel. Performing this process is difficult. This process is moreover complicated because it involves numerous parameters relating in particular to cooling of the metal. Its application to all types of metal, particularly to metals of high melting point, will thus be seen to be very delicate.

There is also taught in U.S. Pat. No. 2,995,788 a process to produce lead weights for automobile wheels. Here again, the metal is of low melting point. The metal enters the mold from below. When the metal is solidified, the molded piece is sheared from the metal solidified in the channel. A shearing blade is provided for this purpose. This process is applicable only to metals having very low resistance to shearing.

The object of the invention is thus to provide a chill molding process with filling of the mold by the difference in pressure between the bath and the mold cavity, so as to permit:

- molding of very diverse materials, particularly alloys, including those containing oxidizable elements;
- rapid production;
- a choice of time periods for solidification, particularly of very short time periods so as to obtain fine grain;
- reduction in turbulence during filling of the mold cavity;
- improvement in the condition of the surface, so as to eliminate or reduce polishing and/or deflashing.

According to the invention, the process is characterized by introducing the molten material into the filling opening of the mold cavity by a conduit having a constriction, raising from the bath the filling opening after solidification of the material in the constriction, and before demolding separating from the chill mold a channel in which is formed the conduit from the filling opening to the constriction, so as to rupture in tension, in the constriction, the material just after solidification.

Contrary to the shearing taught by U.S. Pat. No. 2,995,788, the tractive rupture is practical with all types of metals, even resistant ones, by mere application of sufficient force.

After this rupture, the material located in the conduit below the point of rupture falls into the bath. During this time, the solidified material which remains attached to the chill mold just above the point of rupture prevents the mold cavity from emptying after rupture has taken place.

After sufficient solidification of the material in the chill mold, the piece can be demolded in a manner known per se comprising separating from each other two or more parts constituting the mold, each of which partially defines the mold cavity.

The process according to the present invention produces remarkable results and advantages.

As the material passes directly from the bath to the mold, the bath may be at relatively low temperature, which saves energy and maintains the efficacy of previous treatments of the bath. The falling back into the bath of the material located below the point of rupture permits also an important energy saving because this material is only slightly chilled before falling back into the bath. After demolding, the flash produced is of relatively low quantity, and it is thus less costly to reheat this excess material to the fusion temperature.

Thanks to the very good seal of a chill mold (compared to that of a sand mold), it is easy to control the pressure difference between the mold and the cavity in the course of the material rising into the mold cavity so that the mold will be filled as quickly as possible without turbulence.

In practice, the rising of the material is sufficiently rapid that the material will not have the time to solidify even if a portion of the mold cavity is relatively thin, for example 3 to 5 mm, and on the other hand the mold is maintained at a temperature below 200° C. permitting it to be classified in the category of molds known as "chill". This is very advantageous for the mechanical construction of the mold and its durability. Moreover, the problems of sealing are considerably simplified.

The invention permits an extremely rapid casting cycle, demolding being possible as soon as the piece is solidified. This permits accelerated cooling, in open air, which permits obtaining for example white cast iron free from ferrite, with extremely fine grain.

But it does not exclude the possibility of slower cooling if that is desired. In that case, the mold may be of the "hot mold" type, which is to say maintained in use at a temperature of the order of 300° to 400° C.

In short, contrary to all previous methods, the invention permits freely choosing the material and the cooling regime.

The pieces obtained have remarkable surface quality for rough castings. Their dimensional precision is excellent, and their tensile strength, as well as their elongation at rupture, are improved.

According to another aspect of the invention, the molding apparatus for practicing the above process, which comprises a mold having an internal cavity, is characterized in that it comprises also, on the mold when the apparatus is in the position of use, a channel comprising a conduit which narrows from a feed opening toward a constricted end which may be placed in substantially sealed communication during casting with a mold cavity and opens through an internal surface of the mold, and means for forcibly separating the channel and the mold from each other.

According to a third aspect of the invention, the mold for practicing the process for use with the apparatus according to the invention, is characterized in that it comprises degassing means connected to the mold cavity so as to open into the region of the latter which is uppermost when the metal flows downward to outside the mold.

Other characteristics and advantages of the invention will become apparent from the following description.

In the accompanying drawings, given by way of non-limiting example:

Figure 1:
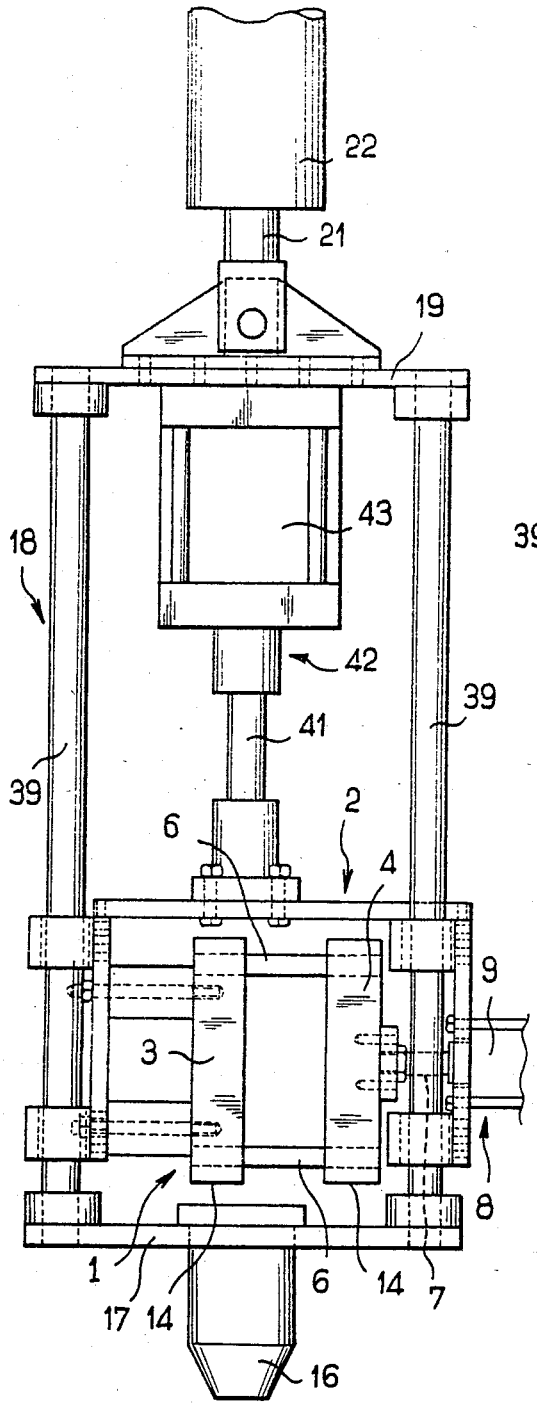
FIG. 1 is a side elevational view of a molding apparatus according to the invention.

The molding apparatus according to the invention will first be described.

The apparatus comprises a permanent mold—or chill mold—1 (FIGS. 1 and 2) carried by a device 2. The mold 1 comprises a mold half 3 which is secured relative to the device 2 and receives slidably two parallel rods 6 fixed to a movable mold half 4, which is thus mounted for sliding movement in a horizontal direction. The movable mold half 4 is attached, on the side remote from the fixed mold half 3, to the rod 7 of a jack 8 whose body 9 is secured to the frame of the device 2. Thanks to the jack 8, whose axis is horizontal, the mold half 4 may be displaced between an open position spaced from the mold half 3 (FIG. 1), and a closed position (FIG. 5) in which the mold halves 3 and 4 are in contact with each other in a vertical mating plane 11 perpendicular to the direction of movement of the mold half 4.

The mold half 3 is recessed so as to define between it and the mold half 4 a mold cavity 12 having the shape of the piece to be produced. In the illustrated example, as shown in FIG. 3 by the shape of the mold cavity 12, the piece to be produced will have three diverging fingers, but of course the invention is not limited to this example.

When the mold halves 3 and 4 are in contact with each other, the mold cavity 12 communicates with the exterior through a flow passage 13, which, according to the invention opens through a lower surface 14 of the mold 1, which is provided with a flat horizontal joint surface.

According to another feature of the invention, the molding apparatus also comprises a channel 16 (FIGS. 1 and 2) carried below the mold 1 by a lower plate 17 of a chassis 18 whose upper plate 19 is suspended from the movable rod 21 of a jack 22.

Figure 3:
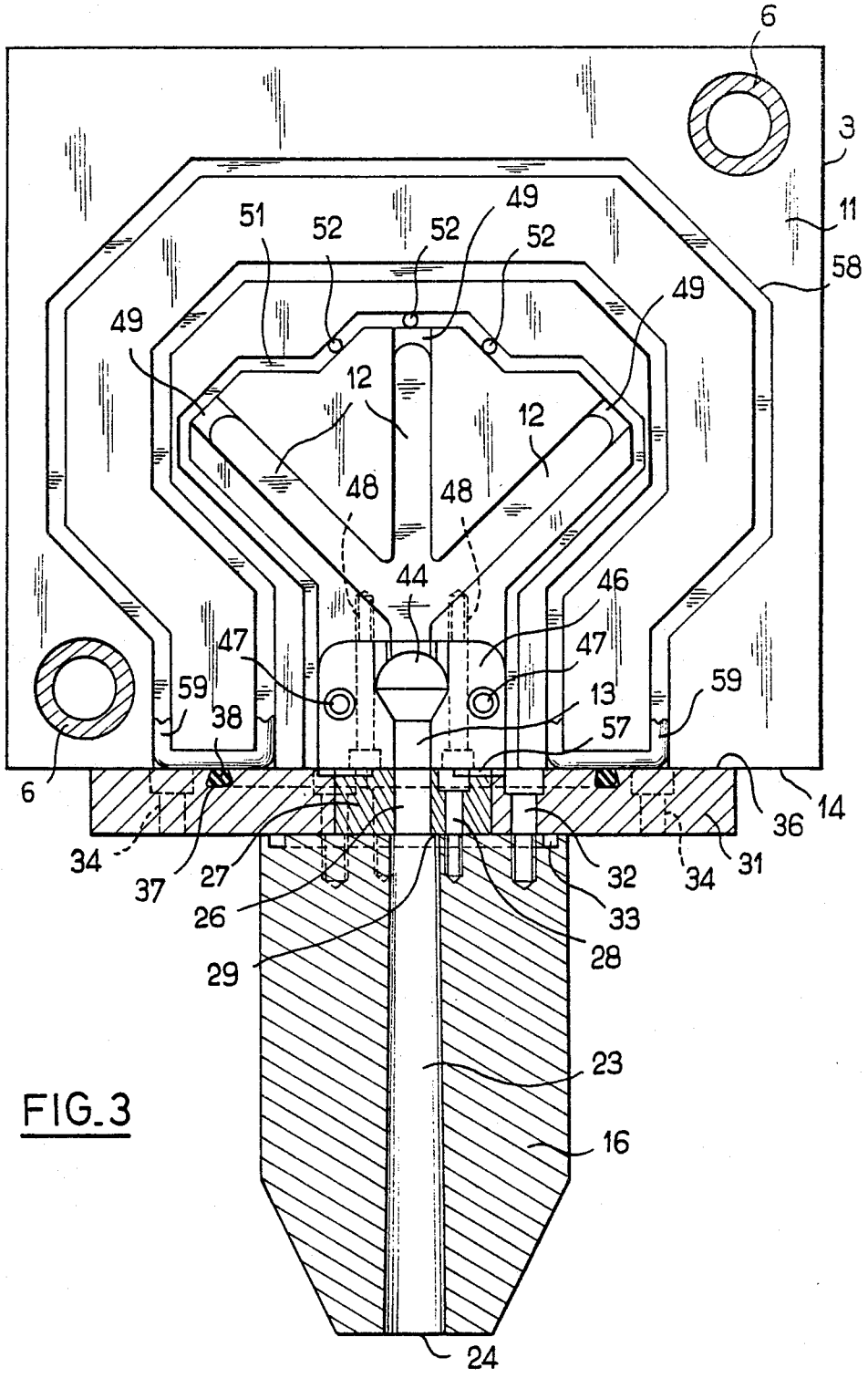
FIG. 3 is a side view of the mold and the channel in their position of mutual contact, in a section along the mating plane of the mold halves.

As shown in FIG. 3, the channel 16 is traversed by a vertical conduit 23 which narrows from a lower feed opening 24 to a constricted upper opening 26. More precisely, a constricted end 26, which is substantially cylindrical, is defined by a wear ring 27 which is secured to the body of the channel 16 by screws 28 and which forms with the rest of the conduit 23 a shoulder 29 that faces the opening 24. Moreover, the conduit 23 is conically flared from the shoulder 29 to the lower opening 24.

Figure 2:
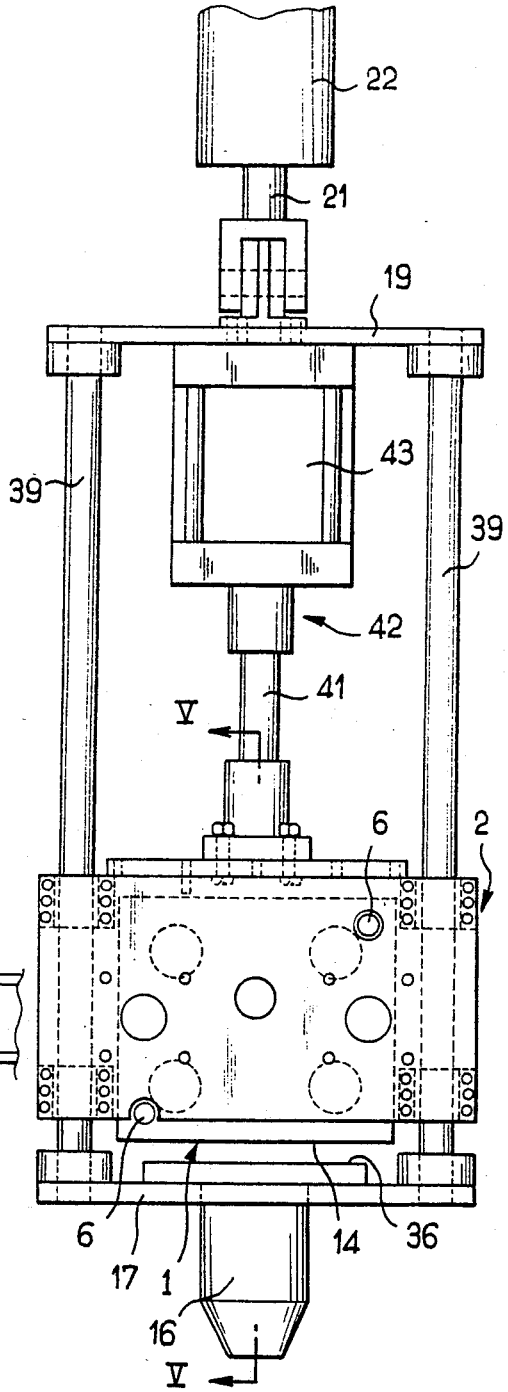
FIG. 2 is a view of the apparatus from the left of FIG. 1.

The channel 16 comprises also a strap 31 fixed to its body about the ring 27 by screws 32, with a sealing joint therebetween occupying a groove 33. The strap 31 forms a collar at the upper end of the channel 16 and has holes 34 (FIG. 3) permitting its securement to the upper face of the plate 17 while the body of the channel 16 extends downwardly through an opening in the plate 17 (FIGS. 1 and 2).

In the position shown in FIG. 3, the lower surface 14 of the mold bears against the upper surface 36, which is generally flat, of the strap 31 and of the wear ring 27, while the constricted end 26 of the conduit 23 coincides with the outlet, of the same diameter, of the flow passage 13. The surface 36 of the strap 31 has, radially between the ring 27 and the screws 34, an annular groove 37 occupied by a joint 38 ensuring sealing between the channel 16 and the mold 1 when these bear against each other.

According to another important feature of the invention, the apparatus comprises means for forcibly separating the channel and mold from each other. To this end, the movable device 2 is mounted for sliding in a vertical direction on four columns 39 (FIGS. 1 and 2) which interconnect the plates 17 and 19 of the chassis 18. Moreover, the device 2 is secured to the movable rod 41 of a jack 42 whose body 43 is fixed below the upper plate 19 of the chassis 18. Thanks to this jack 42 whose axis is vertical and parallel to columns 39, the mold 1 is movable between the position shown in FIG. 3, of sealed contact with channel 16, and the position shown in FIG. 2, in which the mold 1, and particularly its joint surface 14, are spaced from the joint surface 36 of the channel 16.

The mold 1 will now be described in detail.

Figure 5:
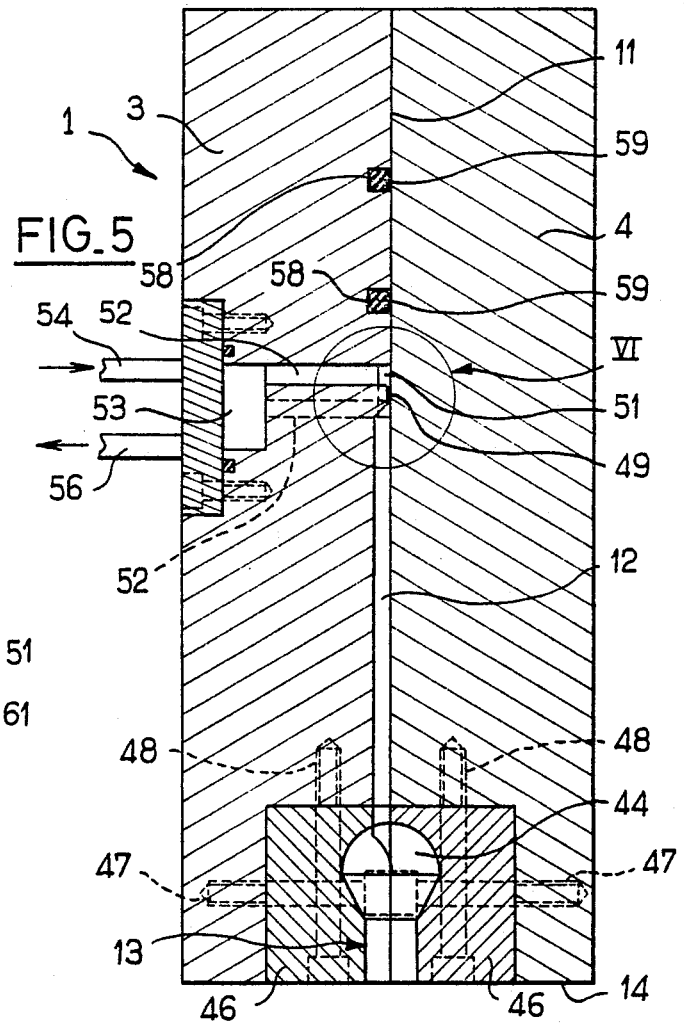
FIG. 5 is a view of the mold in section on the plane V—V of FIG. 2.

As shown in FIGS. 3 and 5, the flow passage 13 has an enlargement 44 at a distance from its opening through the surface 14, this opening thus forming a throat or constriction relative to the enlargement 44. From the surface 14 to the enlargement 44, the flow passage 13 is defined between two wear members 46 mounted by means of screws 47, 48 and which each forms a part of one of the mold halves 3 or 4. The two wear members 46 are disposed in corresponding recesses in the body of the mold halves 3 and 4. When these latter are in mutual contact, the wear members 46 are themselves in contact with each other in the mating plane 11.

At each of its highest points, the mold cavity 12 is connected with ventilating and degassing means. In the illustrated example (FIG. 3), the end of each of the three fingers of the mold cavity 12 constitutes a highest point.

As shown in FIGS. 3 and 5, the mold half 3 has in prolongation of the end of each of the fingers of the mold cavity 12, a recess 49 having a very shallow depth (for example 0.1 mm) which connects the mold cavity 12 with a hollow channel 51 in the surface of the joint of the mold half 3 about the mold cavity 12. By means of conduits 52 provided through the mold half 3 transversely to the plane 11, the channel 51 communicates with a manifold 53 which in turn communicates with a tube 54 for feed of nitrogen under pressure and a tube 56 connected to the inlet of a vacuum pump.

As shown in FIG. 3, the channel 51 extends downwardly on each side of the mold cavity 12 to the lower surface 14, and then along each side of the wear member 46 of the mold half 3 so as to communicate with the interstices between the members 46 and the wall of the corresponding recesses in the bodies of the mold halves 3 and 4.

Figure 4:
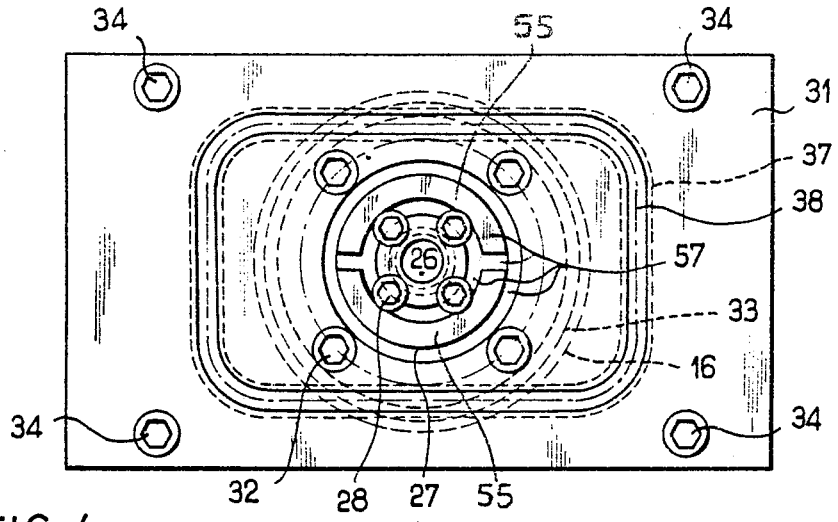
FIG. 4 is a view from above of the channel.

The channel 51 which is thus of generally U-shaped configuration opens at each of its ends confronting the surface 36 of the channel 16 so as to communicate with a recess 57 of shallow depth provided in said surface so as to communicate with the interstices between the ring 27 and the strap 31 and between these two elements and the body of the channel 16, and with the holes receiving the screws 28 and 32. The recess 57 has the form of two rings (FIG. 4) connected to each other by two opposed radial passages between two semi-circular lugs 55 of the ring 27.

The mold half 3 also comprises in its mating surface a channel 58 extending in a U-shaped loop, which is to say extending along two Us disposed one inside the other and connected at their ends, which are adjacent the surface 14. Between these, the two Us embrace the mold cavity and the channel 51.

In the channel 58 is mounted a joint 59 which is toric before mounting, of which only two parts adjacent the surface 14 are shown in FIG. 3. These two parts project from the surface 14 and thus bear in sealing relation against the joint 38 of the strap 31. Thus, when the mold 1 is applied against the channel 16, the mold cavity 12 is closed in a sealed manner everywhere except its communication with the conduit 23 of the channel 16 and with the manifold 53.

Figure 6:
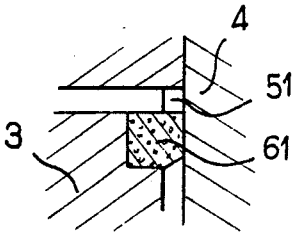
FIG. 6 is a view on an enlarged scale of detail VI of FIG. 5, according to a modified embodiment.
Figure 7:
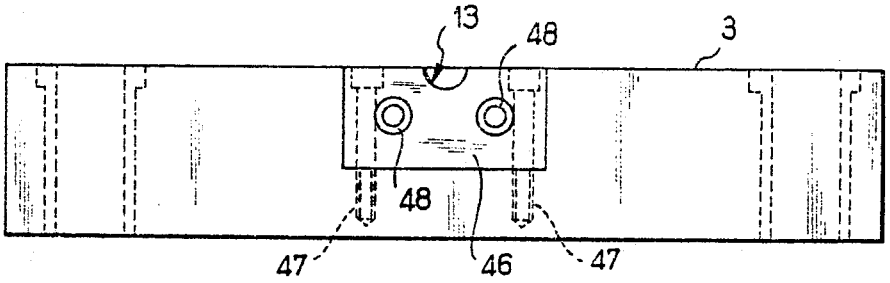
FIG. 7 shows a mold half from below.

As shown in FIG. 6, the recess 49 at the end of each finger of the mold cavity 12 may be replaced by a porous body 61 secured to the mold half 3 and in contact with the mold half 4 when the two mold halves are in mutual contact, the body 61 being interposed between the end of the finger in question and the collector channel 51.

The molding process according to the invention will now be described with reference to FIGS. 8 to 16.

At the outset (FIG. 8) the mold 1, whose two mold halves 3 and 4 are in contact with each other, is itself in contact with the strap 31 of the channel 16. Thanks to the jack 22 (not shown in FIG. 8), the chassis 18 has been lowered such that the lower end of channel 16 is just above the surface of the bath 62 of molten material to be molded.

Nitrogen (or argon, if nitrogen is soluble in the molten bath) under pressure is blown into the mold cavity by the conduit 54. At the same time, the vacuum pump connected to conduit 56 operates but, its output being less than the output of the pumped nitrogen, the nitrogen spreads over the bath through the lower opening of the channel 16, which blows away from the axis of the channel 16 the slag on the surface of bath 62.

Figures 13, 14, 15, 16:
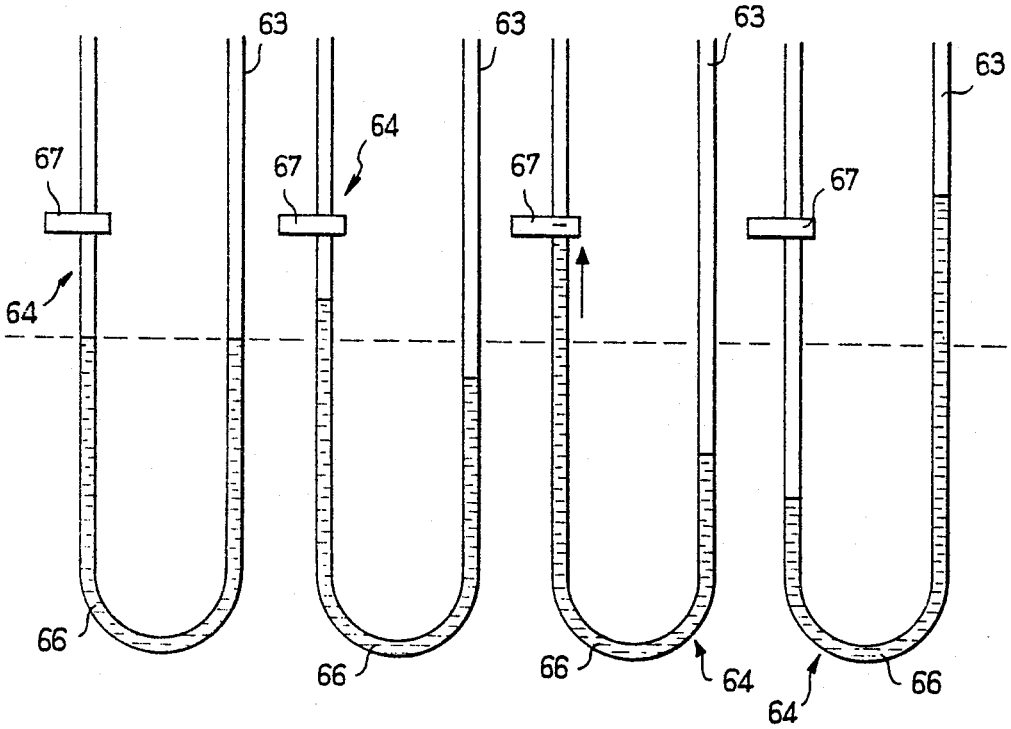
FIGS. 13 to 16 are schematic views of the manometric apparatus for triggering the aspiration, at four stages of the process.

Meanwhile, the pressure in the mold cavity 12 is measured, or a pressure representative of the pressure existing in the mold cavity 12 (for example the pressure in the manifold 53). To do this, this pressure is transmitted to one of the upwardly directed ends 63 (FIGS. 13 and 14) of a U tube 64 containing a certain quantity of mercury 66. The leg of the tube 64 which is remote from the end 63 is provided with a detector 67 located above the surface of the mercury 66 at rest (FIG. 13). This detector 67 comprises two electrodes which are opposed in the tube 64 such that an electric circuit will be closed by the mercury if it reaches the electrodes.

Figure 8:
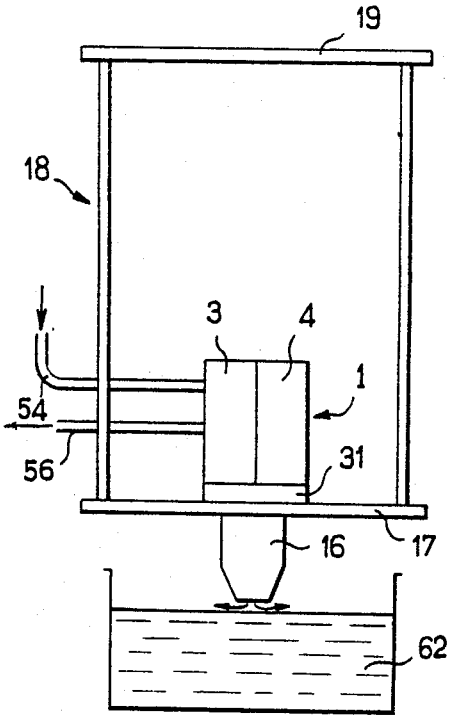
FIGS. 8 to 12 are schematic views in side elevation of the apparatus and the bath in the course of five successive stages of the process.

In the condition shown in FIG. 8 (blowing nitrogen on the surface of the bath), the pressure in the mold cavity is relatively low and insufficient to push the mercury 66 to the detector 67 (FIG. 14).

Figure 9:
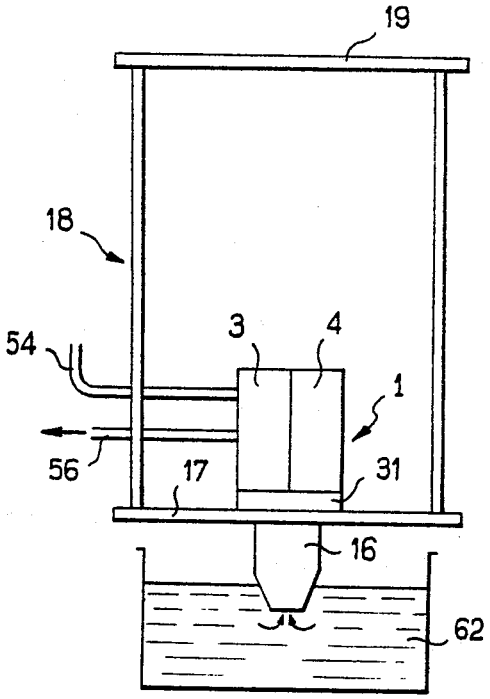
Figure 10:
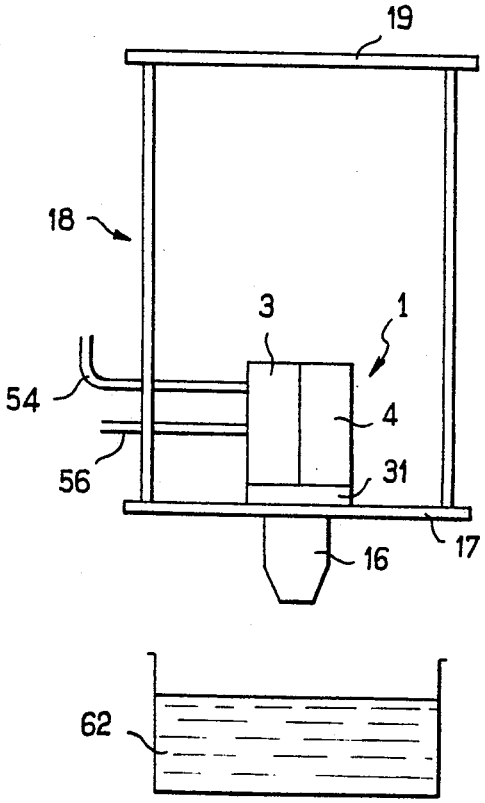

Then, as shown in FIG. 9, the chassis 18 is lowered (by means of jack 22 not shown) so as to immerse the channel 16 in the bath 62. This constitutes an obstacle for the escape of nitrogen arriving through the conduit 54, such that the pressure at the end 63 of tube 64 (FIG. 15) sharply increases and pushes the mercury 66 to the detector 67. This latter emits a signal which controls the interruption of blowing nitrogen, and thus the creation of a vacuum in mold cavity 12 by the vacuum pump connected to conduit 56. Then, the molten material of the bath 62 is aspirated by the nozzle 16 and fills the mold cavity defined by the two mold halves 3 and 4. The aspiration takes place not only in the mold cavity 12 per se but also in all the interstices adjacent to the wear members 27 and 46 and in the holes occupied by mounting screws 28, 32 and 48. Thus the risk is avoided that gas imprisoned in these interstices and abruptly expanded by the arrival of the molten material will form bubbles in the molded piece.

As shown in FIG. 16, during aspiration of the molten material, the mercury is substantially spaced from the detector 67 but the electrical installation is such that the nitrogen blowing will remain interrupted.

The vacuum in the mold cavity during aspiration may be regulated such that the filling will take place as quickly as possible without however causing turbulence and splashing in the mold cavity. Especially, it may be advantageous to vary the aspiration pressure in the course of the aspiration phase depending on the shape of the mold cavity. The vacuum pump used is associated with means permitting such regulation.

The greatest dimension of the mold cavity being vertical, in the course of filling the mold cavity the material will have a free surface which is relatively small and which has a relatively large vertical displacement. Thanks to the relatively small surface, the risk of turbulence and splashing is greatly reduced and the progress of the fused material in the mold cavity is easily controllable. It is for this reason that, according to the invention, it is preferred that the mating plane between the two mold halves, which corresponds substantially to the plane passing through the two largest orthogonal dimensions of the piece to be produced, be vertical as in the example described and shown, or oblique as may be advantageous for certain pieces to be produced.

When the fused material reaches the upper end or the upper ends of the mold cavity, it cannot enter the recesses 49 (FIG. 5) or the pores of the body 61 (FIG. 6) because these passages have dimensions too small relative to the viscosity of the fused material.

At this stage, the aspiration is maintained for a time sufficient for the material to begin its solidification in the constricted end 26 of the conduit 23 and/or in the entrance throat of the flow passage 13. This beginning of solidification closes the mold and therefore traps the material which is in it. At this stage (FIG. 10) the chassis 18 is raised by the jack 22 (not shown) so that the channel 16 leaves the bath at 62.

Then (FIG. 11) the jack 42 (not shown in this figure) is actuated so as to separate the mold 1 and the strap 31 of the channel 16 from each other. This effects a rupture of the material partially solidified in the vicinity of the surfaces 14 and 36 which separate under the effect of this movement. Thus, the material in the conduit 23 of the channel 16 is retained in the channel 16 by the shoulder 29 (FIG. 3). On the other hand, the material contained in the mold 1 is retained in the latter thanks to the enlargement 44. The presence of the enlargement 44 prevents the tractive force necessary to effect rupture, from being borne by the piece undergoing solidification in the mold cavity 12.

Figure 11:
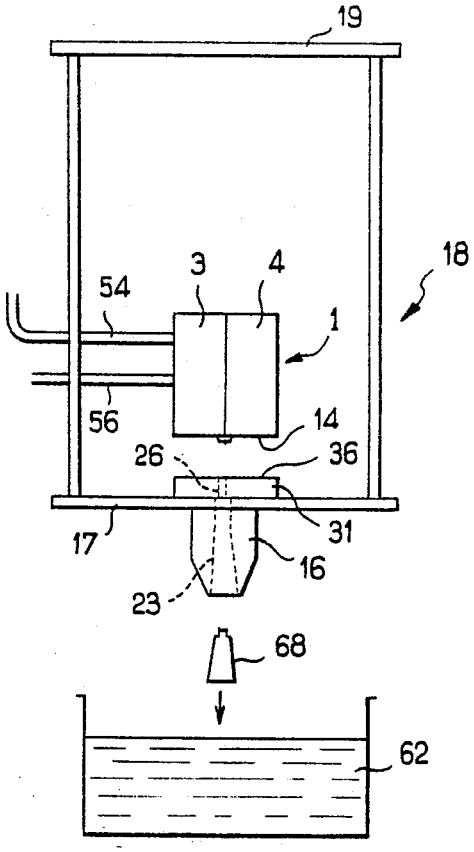

As shown in FIG. 11, thanks to the conical shape of the conduit 23 in the channel 16, the material 68 contained in the channel 16 falls back into the bath 62 and may be rapidly reheated there and remelted because its temperature is only slightly less than its solidification temperature.

Figure 12:
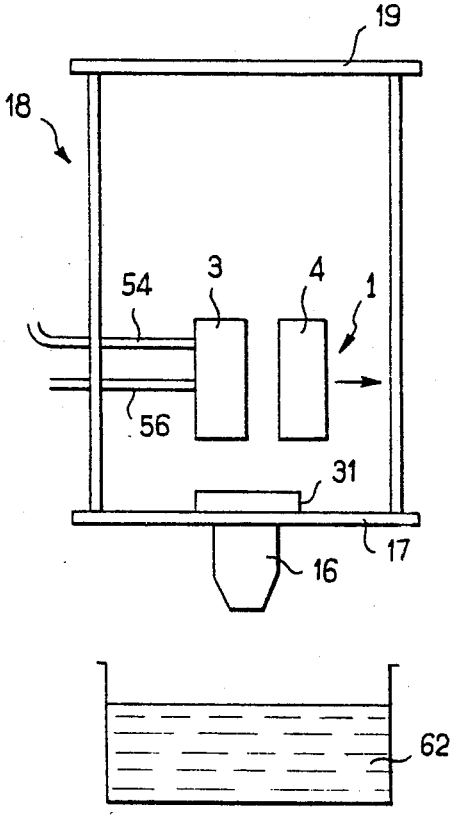

Then, as shown in FIG. 12, the jack 8 (not shown in this figure) is actuated to separate the mold halves 3 and 4 from each other and to demold the piece that has solidified in the mold cavity 12. The mold and the channels may be made of any appropriate material, as a function of the material to be molded, the conditions of cooling which are desired, etc. . . .

Preferably, if the molding material has a relatively high melting temperature, if for example it is a ferrous metal or refractory oxide, the channel 16 is of copper or high copper alloy so as quickly to remove heat when it is immersed in the bath. It is even possible to provide cooling means in the channel, particularly in the straps 31, which also has the advantage of accelerating hardening of the molding material in the region in which rupture is to take place.

The mold may be made of copper, high copper alloy, steel, cast iron, etc. . . . , according to the operating temperatures foreseen and the desired rapidity of cooling. The wear members 27 and 46 may be of the same material as the rest of the channel and respectively of the mold, the object of their detachably being essentially to limit the cost of maintenance.

The mold may also have several regions of different material to create various cooling conditions in different regions of the mold cavity, so as to impart to the piece to be made mechanical qualities which differ from one place to another if that is desired.

It is also possible that the mold cavity or a portion of the same be lined with a layer of ceramic to retard cooling.

The mold cavity remaining relatively cold, there are no problems of differential expansion between the various regions of the mold, or between the mold and the lining.

Conclusive tests have been effected with molds defining mold cavities of a thickness of 3 mm. It is surprising that under these circumstances, the rising of the metal in the mold cavity could be sufficiently rapid that the metal will have the time to occupy all the mold before a solid plug is formed in one region or another of the mold cavity, and this despite the fact that the mold was maintained at a temperature of about 200° C. (chill mold).

Of course, the invention is not limited to the examples described and shown.

Thus, for relatively complicated pieces, the mold could be in more than two parts movable relative to each other to permit demolding.

Thanks to the blowing of nitrogen or argon before aspiration, the presence of oxidizing gases and humidity is avoided in the mold cavity during aspiration. By detecting the increase of pressure occasioned in the mold cavity by the immersion of the channel in the bath, the aspiration is triggered as soon as that is possible without loss of time. But all this is not indispensable. In any event, the detection by the mercury column such as shown in FIGS. 13 to 16 may be replaced by other known means of pressure detection.

Instead of relying on aspiration in the mold cavity, the rising of the material may be effectuated by establishing an increase of pressure on the surface of the bath.

Improved molding apparatus may comprise several molds mounted on a rotary table and passing step by step above the bath for the operations of filling and rupturing, then, after a complementary cooling time if desired, to a demolding station.

The present invention was made at the Laboratory of Applied Geology and Geochemistry of the University of Orleans with the assistance of research team No. 601 associated with the Centre National de la Recherche Scientifique (CNRS).

We claim:

1. A molding method to produce a molded piece of a material of high melting point, comprising the steps of:
(a) forming a bath of molten material;
(b) bringing an upper end of a highly heat-conductive channel, having an internal conduit provided with a constriction at said upper end, into releasable leak-tight fluid communication with an aperture of a mold cavity provided in a mold;
(c) immersing in said bath a lower end of said channel;
(d) withdrawing gas contained in the mold cavity to allow said material to move upwardly from said bath through said channel into said mold cavity until said mold cavity is substantially filled;
(e) allowing the material to solidify in the constriction;
(f) raising said mold and said channel so as to move said lower end of said channel out of said bath;
(g) spacing apart said mold and said channel from each other so as to rupture in tension solidified material in said constriction;
(h) allowing material remaining in said channel to return into said bath of molten material; and
(i) demolding said molded piece by separating the mold into plural portions.

2. A molding method according to claim 1, wherein said channel is essentially made of copper.

3. A method according to claim 1, wherein demolding is performed by separating from each other two mold halves having a substantially vertical mutual contact plane.

4. A method according to claim 1, wherein withdrawing gas contained in the mold cavity to fill said cavity with molten material is performed by establishing in said cavity a vacuum which is regulated in a way tending to reduce turbulence.

5. A method according to claim 1, wherein after bringing the upper end of the channel into leak-tight releasable fluid communication with the mold cavity, an inert gas is blown into the mold cavity while the lower end of the channel is above the bath.

6. A method according to claim 5, wherein said blowing is maintained until the moment in which the filling opening is immersed in the bath, the escape of inert gas through the filling opening being thus at least retarded by this immersion, detecting during this time a parameter such as the inert gas pressure or flow rate, on which the retardation of escape via the channel has an influence and, in response to this detection, subjecting the mold cavity to vacuum for aspirating the fused material into the mold cavity upon detection of said retardation.

7. A method according to claim 6, wherein during filling, gas displaced by the fused material in the mold cavity is collected via a porous body adjacent to the mold cavity.

8. A molding method to produce a molded piece of a material of high melting point, comprising the steps of:
forming a bath of molten material;
bringing an upper end of a channel, having an internal conduit provided with a constriction at said upper end, into releasable leak-tight fluid communication with an aperture of a mold cavity provided in a mold;
blowing an inert gas into said mold cavity while a lower end of the channel is above the bath;
lowering the lower end of the channel while maintaining said blowing until the lower end of the channel is immersed in the bath, the escape of inert gas through the conduit of the channel being thus at least retarded by this immersion;
meanwhile, detecting a parameter such as the inert gas pressure or flow rate, on which retardation of escape via the channel has an influence and comparing said parameter with a known value at which escape retardation occurs and, when said detected value equals said known value, drawing a vacuum in the mold cavity for aspirating the fused material into the mold cavity upon detection of said retardation until said mold cavity is substantially filled;
allowing the material to solidify in the constriction;
lifting up said mold and said channel so as to move said lower end of said channel out of said bath;
spacing apart said mold and said channel so as to rupture in tension solidified material in said constriction;
allowing material remaining in said channel to return into said bath of molten material; and
demolding said molded piece by separating the mold into plural portions.

9. A method according to claim 8, and collecting, during filling, gas displaced by the fused material in the mold cavity, via a porous body adjacent to the mold cavity.

10. A molding apparatus comprising:
a container for a bath of molten material;
a mold provided with an internal mold cavity and comprising plural separable portions;
a channel made of a highly heat-conductive material and having an internal conduit, said conduit being provided with a constriction at an upper end of said channel and said upper end being adapted to be brought into releasable leak-tight fluid communication with an aperture of said mold cavity through a lower face of said mold;
means for bringing the upper end of said channel into releasable leak-tight fluid communication with said aperture of the mold and for forcibly separating the channel from the mold;
means for immersing a lower end of said channel in said bath and for raising said lower end out of the bath; and
means for separating the mold into said plural portions.

11. An apparatus according to claim 10, wherein means are provided for withdrawing gas contained in said mold cavity to allow said molten material to move upwardly through said channel into said mold cavity.

12. An apparatus according to claim 10, wherein said plural portions are essentially made of copper.

13. Apparatus according to claim 10, wherein the constricted end of the conduit of the channel is defined by an associated wear member.

14. Apparatus according to claim 10, wherein the mold comprises at least two mold halves defining the mold cavity between themselves and separably applied against each other on a mating surface which in operation is substantially vertical.

15. Apparatus according to claim 14, comprising between the two mold halves a joint in the form of a closed loop disposed in a U about the mold cavity so as to be capable of sealed contact of the two ends of the U with an annular joint surrounding the constricted end of the conduit of the channel.

16. Apparatus according to claim 10, wherein the mold comprises at least a channel interconnecting mounting interstices, adjacent to a mating plane between the mold and the channel, with degassing means.

17. Apparatus according to claim 10, comprising blowing means in the mold cavity, and means responsive to pressure in the mold cavity to produce vacuum in the mold cavity when the pressure in the mold cavity reaches a predetermined value.

18. Apparatus according to claim 10, comprising means to regulate the pressure difference between the mold cavity and the surface of the bath in the course of filling of the mold cavity.

19. Apparatus according to claim 10, comprising a chassis carrying the channel, a first jack to displace vertically the chassis, a device mounted for vertical sliding movement on the chassis and carrying the mold and a second jack to displace the device relative to the chassis between a sealed communication position of the channel with the mold and a position in which the mold is spaced apart from the channel.

20. Apparatus according to claim 10, wherein the channel is made of a material containing at least a major proportion of copper.

21. A molding apparatus comprising:

a container for a bath of molten material;

a mold comprising at least two mold halves defining a mold cavity between themselves and separably applied against each other on a mating surface which in operation is substantially vertical;

a channel having an internal conduit, said conduit being provided with a constriction at an upper end of said channel, and said upper end being adapted to be brought into releasable leak-tight fluid communication with an aperture of said mold cavity through a lower face of said mold, by means of an annular joint surrounding the constricted end of the conduit of the channel;

between said two mold halves, a joint in the form of a closed loop disposed in a U about the mold cavity so as to be capable of sealed contact of the two ends of the U with said annular joint surrounding the constricted end of the conduit of the channel;

means for bringing the upper end of said channel into releasable leak-tight fluid communication with said aperture of the mold and for forcibly separating the channel relative to the mold;

means for immersing a lower end of said channel in said bath and for raising said lower end out of the bath; and means for separating the mold into said mold halves.

22. Molding device comprising at least two mold halves separably assembled on a mating surface and defining between them a mold cavity communicating with the outside by a flow passage through a bottom face of the mold, a channel adapted to be releasably applied against said bottom face in fluid communication with said flow passage, said flow passage having an enlargement at a distance from said bottom face, said enlargement being adapted to protect the material undergoing solidification in the mold cavity from tractive forces effecting rupture of solidified material adjacent said bottom face when the mold halves are forcibly spaced apart from the channel, wherein said molding device comprises at least one secured wear member defining at least the lower end of the flow passage, and wherein interstices adjacent to the secured wear member are connected to gas drawing means through channel means.

23. Mold according to claim 22, wherein the two mold halves are made of copper.

24. Molding device comprising at least two mold halves separably assembled on a mating surface and defining between them a mold cavity communicating with the outside by a flow passage through a bottom face of the mold, a channel adapted to be releasably applied against said bottom face in fluid communication with said flow passage, said flow passage having an enlargement at a distance from said bottom face, said enlargement being adapted to protect the material undergoing solidification in the mold cavity from tractive forces effecting rupture of solidified material adjacent said bottom face when the mold halves are forcibly spaced apart from the channel, wherein the flow passage is formed between the two mold halves and opens to the exterior of the mold substantially perpendicular to the surface of the joint between the two mold halves.

25. Mold according to claim 24, wherein the two mold halves are made of copper.

* * * * *